US006845541B1

(12) United States Patent
Lai

(10) Patent No.: US 6,845,541 B1
(45) Date of Patent: Jan. 25, 2005

(54) SHOE LAST RACK

(76) Inventor: David Lai, 22050 Linden Ave., South San Francisco, CA (US) 94080

( * ) Notice: Subject to any disclaimer, the term of this patent is extended or adjusted under 35 U.S.C. 154(b) by 0 days.

(21) Appl. No.: 09/568,686

(22) Filed: May 11, 2000

(51) Int. Cl.[7] ..... A47L 23/18; A43D 3/14; A43D 5/00

(52) U.S. Cl. ..... 15/267; 12/123; 12/133 R; 12/141; 15/265; 15/268

(58) Field of Search ..... 15/258, 259, 265, 15/266, 267, 268; 12/128 R, 133 R, 141, 123; 211/34, 35

(56) References Cited

U.S. PATENT DOCUMENTS

| | | | | | |
|---|---|---|---|---|---|
| 1,714,997 A | * | 5/1929 | Wright | 12/135 R |
| 1,859,536 A | * | 5/1932 | Schulse | 12/53.7 |
| 2,459,310 A | * | 1/1949 | Crow | 12/123 |
| 3,860,986 A | | 1/1975 | Ballard | 12/115 |
| 4,376,486 A | | 3/1983 | Arcadi | 211/35 |
| 4,483,039 A | * | 11/1984 | Breen | 15/268 |
| 4,718,135 A | | 1/1988 | Colvin | 12/115 |
| 5,695,073 A | | 12/1997 | Klein | 211/35 |
| 5,745,944 A | * | 5/1998 | Hall | 12/117.4 |

* cited by examiner

*Primary Examiner*—Mark Spisich
*Assistant Examiner*—Shay Balsis
(74) *Attorney, Agent, or Firm*—Robert Samuel Smith

(57) ABSTRACT

A shoe last and a device for detachably mounting the last on a vertical surface that firmly supports the last permitting a user to conveniently polish a shoe mounted on the last. A knob is mounted on the heel section of the last that provides a grip when it is desired to withdraw the last from a shoe. A hinge bar is provided that has one end hinged to a base surface and another end with an aperture into which the knob may be inserted and clamped when it is desired to secure the shoe on the last in a position convenient for polishing. The inclination of the hinge bar may be clamped at an angle selected by the user. When it is desired to store the last (with shoe mounted on the last) the last is attached to any one of numerous locations on a rack by inserting the knob into an aperture ate the selected location.

5 Claims, 6 Drawing Sheets

SHOE LAST RACK

FIELD OF THE INVENTION

This invention relates to a shoe last and particularly to a shoe last that is mountable on a support for shining and/or storing the shoe.

PRIOR ART AND INFORMATION DISCLOSURE

Shining shoes is a job that many people do not relish. This is largely because of the inconvenience of supporting the shoe with one hand while applying polish or brushing the shoe with the other hand. Generally, the last step in polishing the shoe is to grasp a cloth with each hand grasping an edge opposite and briskly rubbing the cloth back and forth in contact with the shoe. The most convenient way to perform this operation is to wear the shoe on one foot and bend and polish the shoe with both hands. This maneuver is difficult for many people because of the bending involved. Shoe lasts have been on the market for many years which have served a dual purpose of maintaining the shape of the shoe when in storage and providing some support when the shoe is being polished. Various approaches to the act of storing the shoe and/or polishing the shoe have been disclosed for many years.

For example, U.S. Pat. No. 3,860,986 to Ballard discloses a shoe tree with at least one insert that is laterally adjustable for predetermined stretch of the upper section of a shoe and operated by means of a retractable mandrel U.S. Pat. No. 4,376,486 to Arcadi discloses a shoe last rack including a base to which are fixed outwardly projecting loops of different sizes, each loop supporting a last.

U.S. Pat. No. 4,718,135 to Colving discloses a shoe last having toe and heel engaging portions connected together at an adjustable distance. U.S. Pat. No. 5,695,073.

U.S. Pat. No. 5,695,073 to Klein et al discloses a hanging shoe rack for supporting shoes at an angle which comprises a plurality of pairs of support arms projecting outwardly and a plurality of horizontal bars, one bar supported on the extending ends of each pair of support bars. Each support bar supports at least one of a pair of shoes.

U.S. Pat. No. 5,745,944 to Hall discloses a door mounted shoe last that is positionable straddling the edge of a door with detachable attachments to both door knobs. The shoe is supported horizontally and extending from the door in a position that frees both hands of the user to enable him to polish the shoe. The shoe may only be supported horizontally and at one height (the height of the door knob). Of course the last must be removed from the door knobs after the polishing operation.

SUMMARY

It is an object of this invention to provide a shoe last which, when inserted into the shoe, is conveniently mountable on a shoe rack of this invention along with a plurality of other similar shoe lasts, each inserted into a shoe. It is another object of the invention that the shoe last inserted into the shoe be detachably attached to a fixture that supports the shoe at an orientation conveniently selected by the user that enables the user to polish the shoe with both hands available as required.

This invention is directed toward a shoe last having a heel portion joined to a toe portion and means for detachably attaching the last to either one of:

(i) a shoe rack along with other lasts of the invention:

(ii) the end of an elongated flat bar whose other end is hingably attached to base such as the inside of a closet door providing that the shoe is supported on the last in a position that is convenient for polishing the shoe.

In one embodiment, a knob is mounted on a top side of the last and extends away from the last. The knob is insertable through a hole in the bar and a clamp lever on the bar is actuated to clamp the last any desired angle of the last relative to the bar. The shoe rack is a base plate with a row of keyhole shaped openings that permit insertion and securing a last in each keyhole.

DESCRIPTION OF PREFERRED EMBODIMENTS

Figure 1:
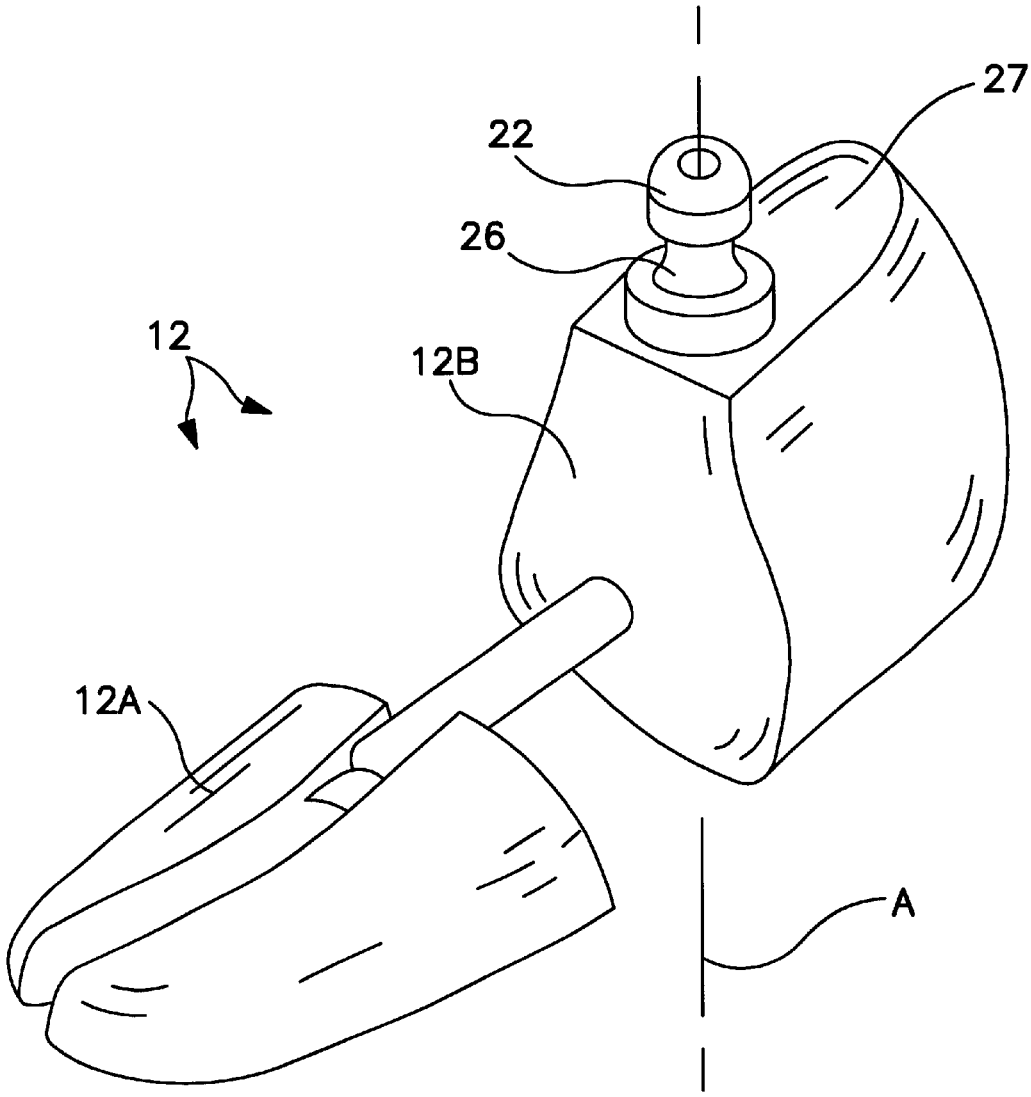
FIG. 1 shows the shoe last of this invention.

Turning now to a discussion of the drawings, FIG. 1 is a perspective view of the shoe last 12 of this invention including a toe section 12A and a heel section 12B. A knob 22 secured on a top surface 27 of the heel section 12B serves the useful purpose of providing a grip for the user when pulling the last from the shoe.

Figure 2:
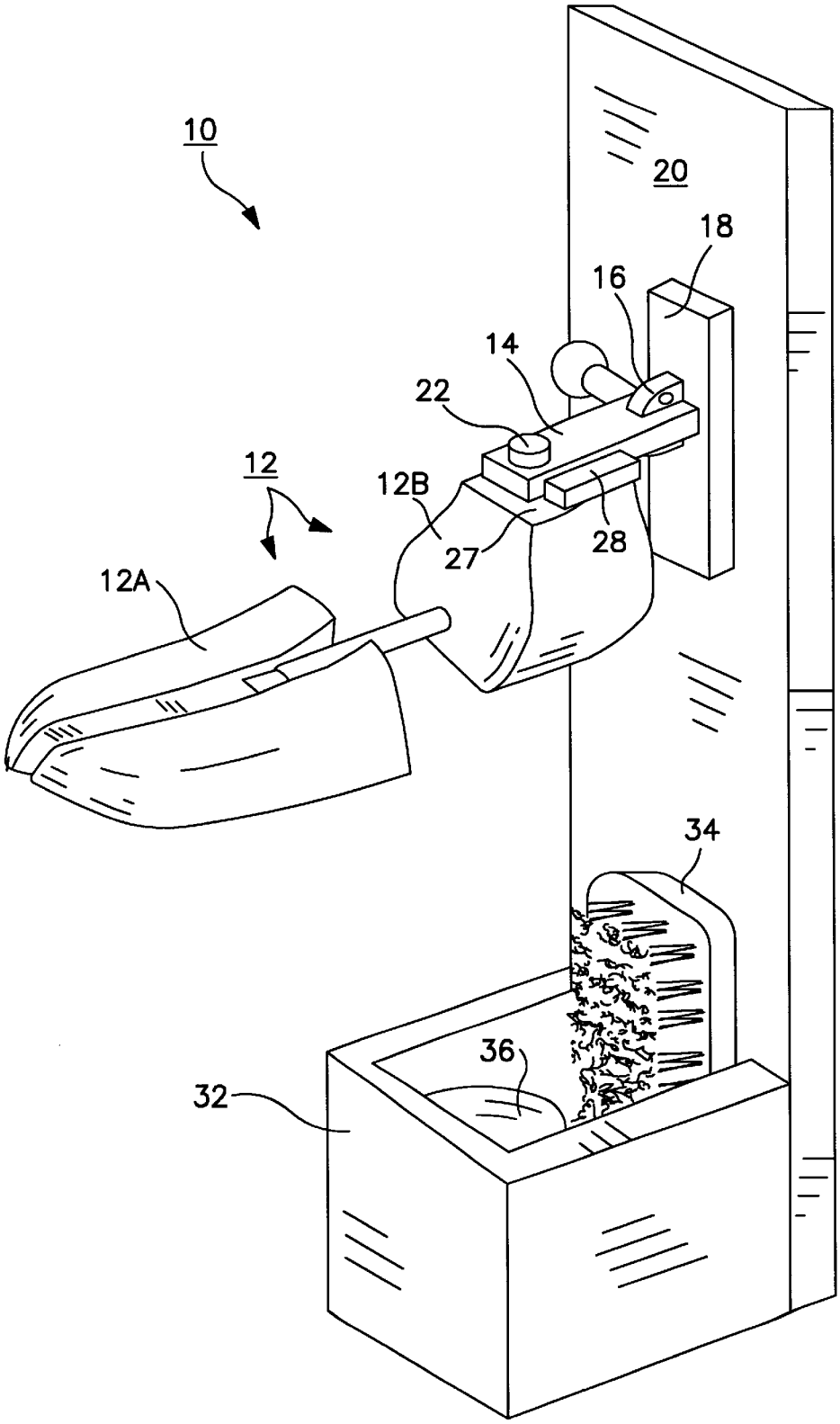
FIG. 2 is an assembly view of the invention.
Figure 3:
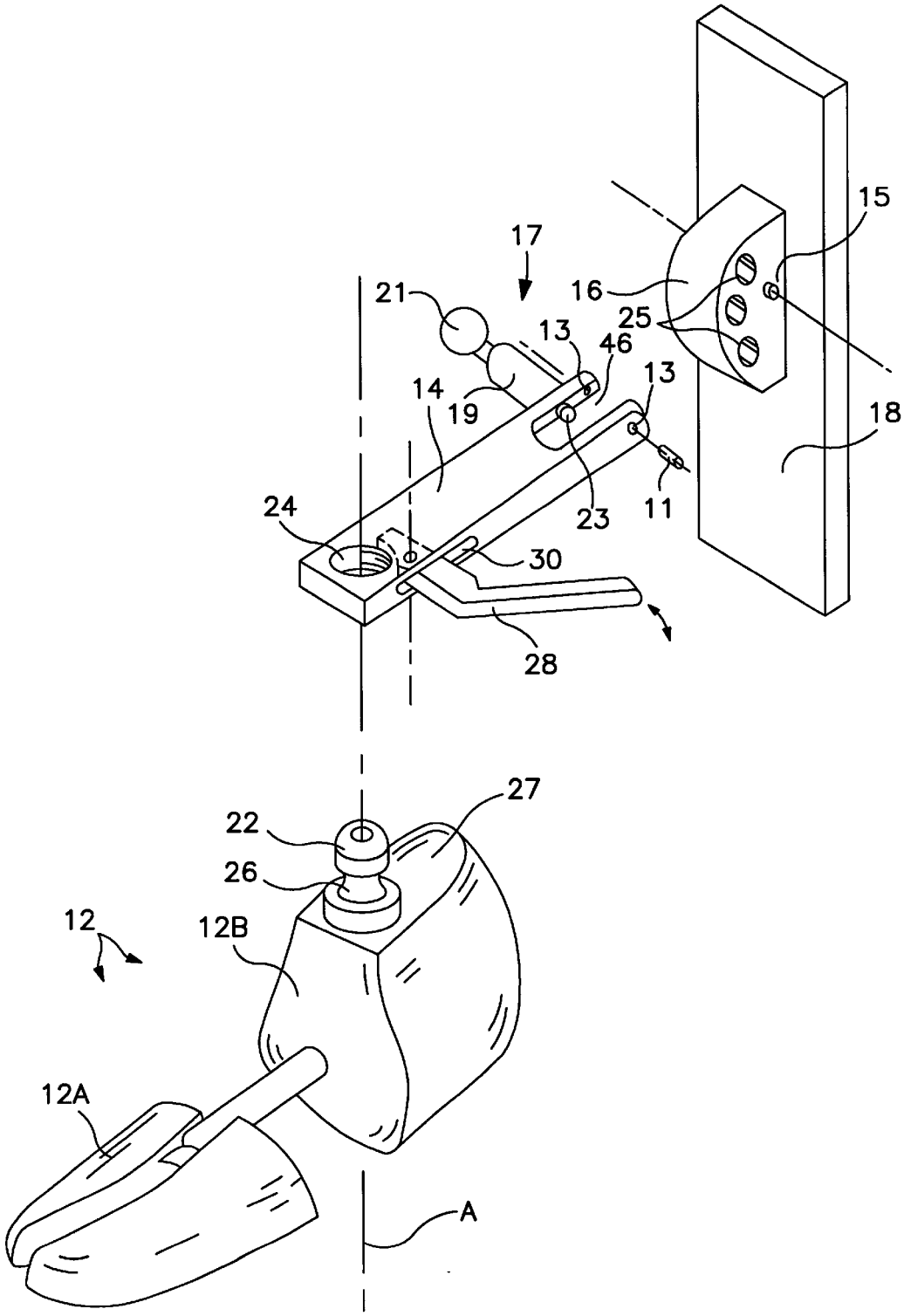
FIG. 3 is an exploded view of the invention.

FIG. 2 is an assembly view and FIG. 3 is an exploded view of an additional embodiment of the invention including a last 12 including a toe section 12A and a heel section 12B. The last 12 is detachably mounted on the free end of a mounting bar 14 whose other end is attached by hinge 16 to a support strap 18. Support strap 18 is secured flush against a support surface 20 such as the inside of a closet door. When it is desired to support the last for polishing a shoe (shoe not shown) on the last, a knob 22 mounted on the top of last 12 is inserted through an aperture 24 of mounting bar 14 and the neck 26 of knob 22 is clamped by turning clamp 28 which is pivotally mounted on bar 14. Clamp 28 extends through a slot 30 in the side of bar 14 in order that it may engage neck 26.

Details of the hinging attachment of mounting bar 14 to support strap 18 include a hinge plate 16 perpendicularly mounted on support strap 18 so that hinge strap 16 extends through a slot 46 in the hinged end of mounting bar 14 where it is pinned by a hinging pin 11 through apertures 13 in mounting bar 14 and aperture 15 in hinge plate 16.

A spring loaded popit pin assembly 17 is shown including housing 19, handle 21 which is attached to an end of pin 23. When assembled, the user can pull handle 21 to retract pin 23 and then engage pin 23 with a selected one of apertures 25 (three are shown). The user is thereby enable to orient the last in any one of three inclinations that are convenient for the user.

The user is therefore to select orientation of the last for a position that is convenient for polishing by rotating the last about centerline A and then tightening clamp 28 and by selecting appropriate hole 25 for locking in the popit pin 23.

As shown in FIG. 2, support surface 20 may in itself be a panel that is attachable to another support surface such as a door. A box 32 is mounted on panel 20 for storing a shoe polish 36 and brush 34.

Figure 5:
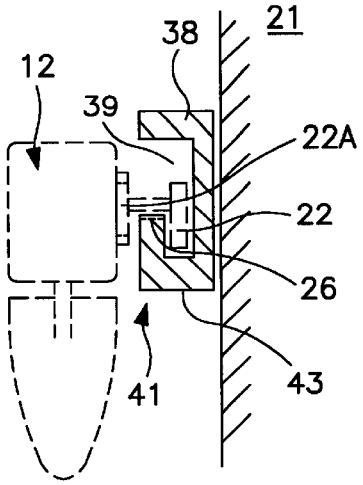
FIG. 5 shows another embodiment of a wall attachment for storing the lasts.
Figure 4:
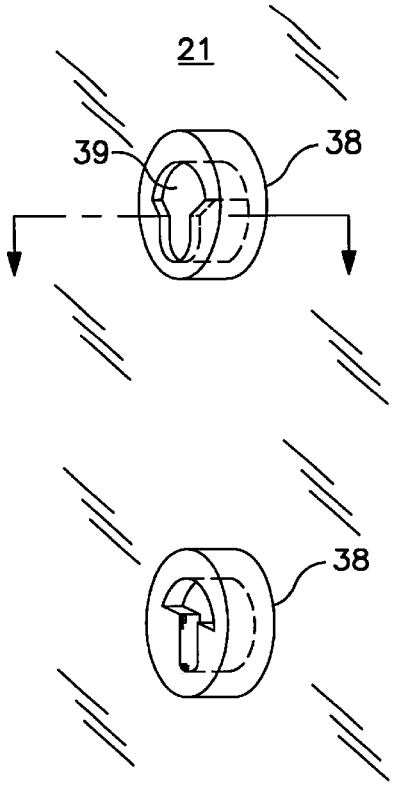
FIG. 4 shows one embodiment of a wall attachment for storing the lasts.

FIG. 4 shows mounting disks 38 (two are shown in FIG. 4), a row of which are mounted on a suitable surface 21 (e.g., an inside surface of a closet door) on which the last 12 may be hung as shown in the sectional view of FIG. 5. Sectional view 4 shows the hole 39 in disk 38 to include a keyhole sections 41 overlying a circular section 43 providing that the knob 22 is insertable into section 43 with the neck 26 in section 41 thereby securing the last. (Last 12 and knob 22 are shown in phantom in FIG. 5.). The mounting disks 38 may be secured to the support surface 21 by any convenient mounting means such as by a screw or adhesive.

Figure 6:
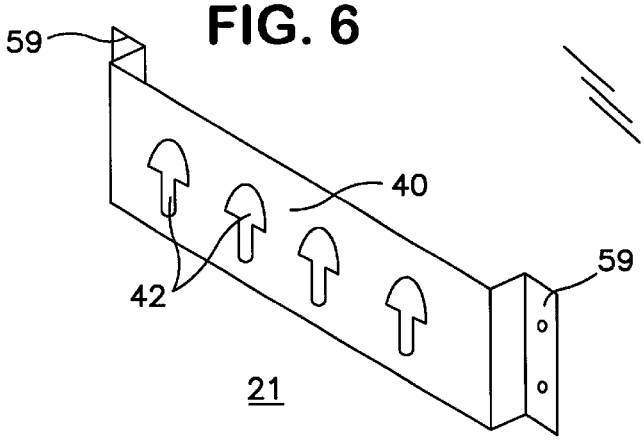
FIG. 6 shows a panel rack with apertures for holding last.

FIG. 6 shows a panel rack with offsets 59 on each end for holding a row of lasts being a panel 40 with an array of keyhole apertures 42 dimensioned so that the knob 22 of each 12 last is securable in one of the apertures 42.

There has been described a shoe last and rack that provides convenience in use as a storage device and as a support for polishing the shoes. The invention is especially useful for the person having a number of pairs of shoes which he/she wishes to maintain in good shape while being stored and which he/she wishes to maintain in a polished state. Variations and modifications may be contemplated after reading the specification and studying the drawings which are within the scope of the invention.

Figure 7:
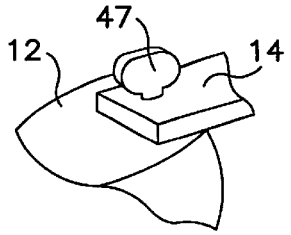
FIG. 7 shows a thumbscrew used to secure the last to the mount bar.

For example, as shown in FIG. 7, in place of the knob 22 and clamp 28, a thumbscrew 47 may be used to bolt the mounting bar 14 against the top of the last 12.

Figure 8:
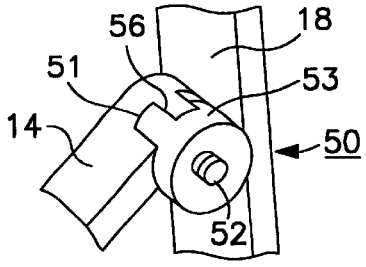
FIG. 8 shows a geared hinge for selected inclination of the last.

In place of the popit pin 17, FIG. 8 shows a geared hinge 50 including one gear hinge section 51 formed on an end of mounting bar 14 and engaging another hinge section 53 formed on the support strap 18. The two hinge sections are held together by spring loaded bolt 52 so that the hinge sections may be selectively oriented with respect to one another by pulling the opposing geared faces 56 apart and orienting the sections at a selected orientation.

Figure 9:
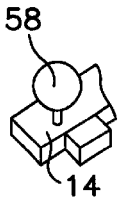
FIG. 9 shows a round knob in place of a disk knob.

FIG. 9 shows a round sphere knob 58 in place of the flat disk knob 22 of FIGS. 1–3

Figure 10C:
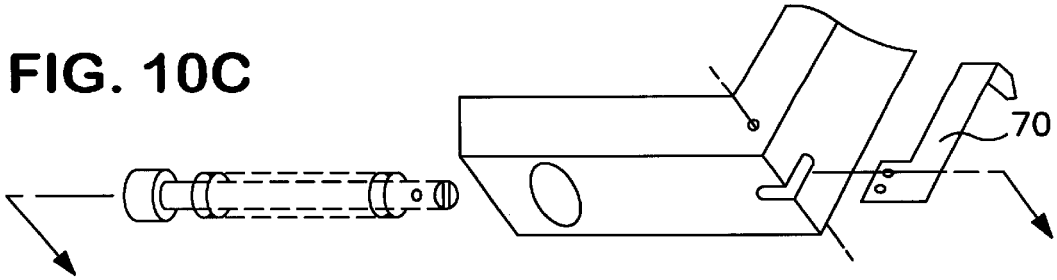
FIGS. 10A–10C show a last designed for a boot.
Figure 10B:
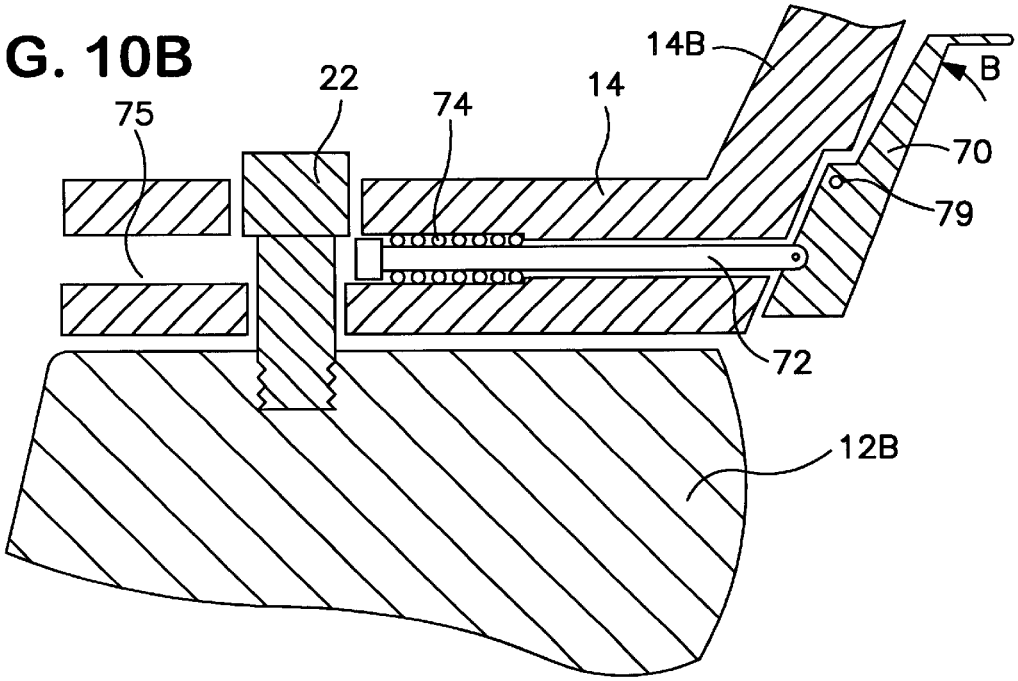
Figure 10A:
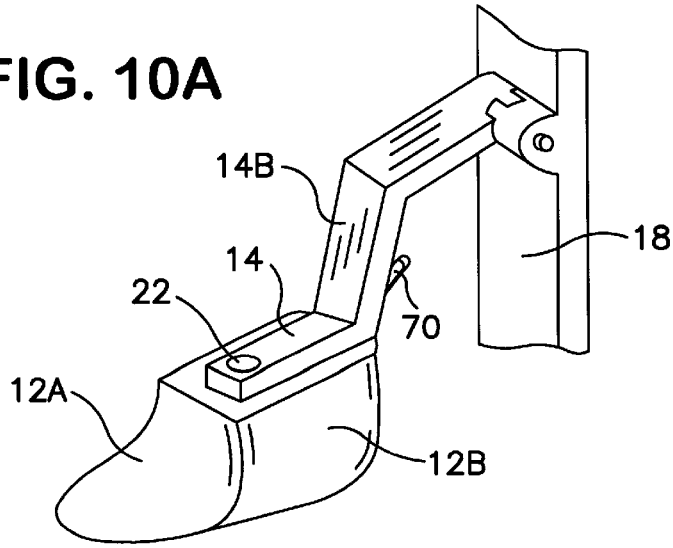
Figure 11:
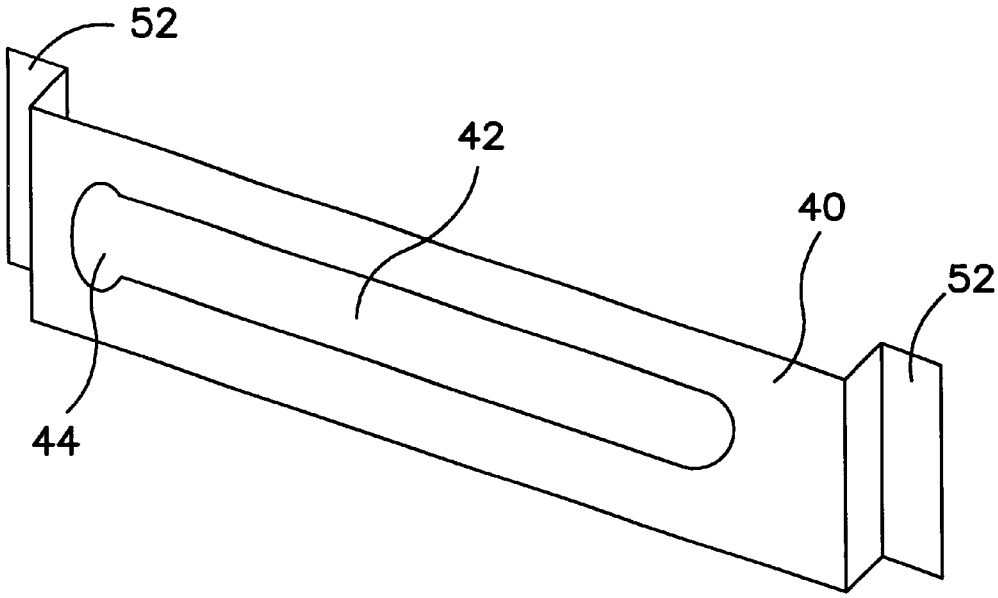
FIG. 11 shows a panel rack with an elongated slot.

FIG. 10A shows the invention having an elongated mounting bar section 14B dimensioned to fit a boot (boot not shown). FIG. 10B is a sectional view and 10 C is an exploded view showing details of the mechanism for locking the knob 22 . A lever 70 is rotated (arrow B) about pin 79 when it is required to separate the last 12 from the mounting bar 14. Plunger 72 is loaded by spring 74 to engage the shaft of knob 22. on one end and at the other end is pivotally attached to lever 70. Lever 70 is pivotally attached to extended mounting bar section 14B FIG. 11 shows a panel rack 90 for holding a row of lasts and having an enlarged opening 94 for inserting the knob 22 of the last and a single elongated slot 92 for holding a row of last.

In view of these and other related modifications, I wish to define the scope of my invention by the appended claims.

I claim:

1. A last (12) for a shoe which comprises:

a toe section (12A);

a heel section 12(B) joined to said toe section;

a knob (22) mounted on a top surface (27) of said heel section operably located to permit a user to grasp said knob as an aid in withdrawing the shoe last from a shoe;

an elongated panel (90) with an offset (69) on each end of said panel (90);

(i) an elongated panel (90) with an offset (69) on each end of said panel (90) and an aperture (94) in one end of said panel (90) dimensioned to permit passing said knob through said aperture (94) and an elongated slot (92) in said panel (90), having one end of said slot (92) communicating with said aperture (94) dimensioned to permit retaining said knob 22 on one side of said panel (90) of said last 12 and said last on an opposite side of said panel (90) whereby a row of lasts is retainable by said panel.

2. A last (12) for a shoe which comprises:

a toe section (12A);

a heel section 12(B) joined to said toe section;

a knob (22) mounted on a top surface (27) of said heel section operably located to permit a user to grasp said knob as an aid in withdrawing the shoe last from a shoe;

a support member (18) having means for securing one side of said support member against a a support surface (20);

a mounting bar (14);

means for hingably attaching one end of said mounting bar (14) to another side of said support member (18) with said mounting bar (14) extending from said support member (18) at a selectably fixed orientation;

said mounting bar having an aperture (24) on an extended end of said mounting bar;

means for securing said knob in a position where said knob is inserted through said aperture whereby said user is enabled to secure said knob (22) in a location and orient said last to a position enable a user to conveniently polish said shoe.

3. The last of claim 2 wherein said means for hingably attaching an end of said mounting bar (14) to another side of said support member (18) with said mounting bar (14) extending from said support strap (18) at a selectably fixed orientation comprises:

one gear hinge section (51) of a geared hinge formed on an end of mounting bar (14);

another hinge section (53) of said geared hinge formed on said support strap (18):

a spring loaded bolt (52) operably arranged to hold said one hinge section and said another hinge section being together in operable arrangement to provide that said one hinge section and said another hinge section are enabled to be selectively oriented with respect to one another by pulling opposing geared faces (56) apart and orienting the said one gear hinge section at a selected orientation with respect to said another hinge gear section.

4. A last (12) for a boot which comprises:

a toe section (12A);

a heel section 12(B) joined to said toe section;

a knob (22) mounted on a top surface (27) of said heel section operably located to permit a user to grasp said knob as an aid in withdrawing the shoe last from a shoe;

a support member (18) having means for securing one side of said support member against a a support surface (20);

a mounting bar having a first section (14) and a second section (14B);

means for hingably attaching one end of said second section (14B) of said mounting bar to a support surface (18) with said mounting bar (14) extending away from said support surface (18) at a selectably fixed orientation;

said second section of said mounting bar (14B) having another end rigidly joined to an end of said first section (14) of said mounting bar at an angle;

said first section (14) of said mounting bar having an aperture (24) on an extended end of said first section (14) of said mounting bar;

means for securing said knob in a position where said knob is inserted through said aperture;

said angle selected to provide that when an end of said second section is hingably attached to said support surface and said knob of said last is detachably attached to said first section, said boot is conveniently oriented for enabling a user to polish said boot.

5. The last of claim 4 wherein said means for securing said knob comprises:

a lever (70); which is depressed when it is required to separate the last (12) from the mounting bar (14);

said lever (70) pivotally attached to said second section (14B) intermediate ends of said lever (70) and intermediate ends of said second section;

a plunger (72) slidably positioned in a bore in said first section (14) and having one end of said plunger (72) pivotally attached to an end of said lever (70);

a spring (74) slidably positioned on said plunger (72);

said first section (14), bore (75), spring (74), first section (14), second section (14B) lever (70) all arranged in operable combination to provide that when another end of said lever is free, one end of said plunger engages and locks said knob (22) and when said another end of said lever (70) is depressed, then said one end of said plunger is disengaged from said knob.

* * * * *